US008944041B2

(12) United States Patent
Hu

(10) Patent No.: US 8,944,041 B2
(45) Date of Patent: Feb. 3, 2015

(54) FIREARM FIRING SYSTEM

(71) Applicant: Shih-Che Hu, Tainan (TW)

(72) Inventor: Shih-Che Hu, Tainan (TW)

( * ) Notice: Subject to any disclaimer, the term of this patent is extended or adjusted under 35 U.S.C. 154(b) by 0 days.

(21) Appl. No.: 13/964,230

(22) Filed: Aug. 12, 2013

(65) Prior Publication Data

US 2014/0373418 A1 Dec. 25, 2014

(30) Foreign Application Priority Data

Jun. 21, 2013 (TW) ..... 102122219 A

(51) Int. Cl.
*F41B 11/62* (2013.01)
*F41A 19/06* (2006.01)

(52) U.S. Cl.
CPC ..... *F41A 19/06* (2013.01)
USPC ..... 124/73; 124/72; 89/129.01

(58) Field of Classification Search
CPC ..... F41B 11/62; F41B 11/56; F41A 19/46; F41A 19/02; F41A 19/06; F41A 17/38
USPC ..... 124/71–73; 89/129.01–132, 136, 139, 89/140
See application file for complete search history.

(56) References Cited

U.S. PATENT DOCUMENTS 1,427,097 A * 8/1922 Feederle ..... 89/137
1,843,916 A * 2/1932 Cole ..... 89/139
1,907,163 A * 5/1933 White ..... 89/137
2,714,334 A * 8/1955 Harvey ..... 89/190
3,240,122 A * 3/1966 Bolles ..... 89/140
3,847,054 A * 11/1974 Ruger et al. ..... 89/129.02
4,143,636 A * 3/1979 Liepins et al. ..... 124/40
5,459,956 A * 10/1995 Rowlands et al. ..... 42/47
5,634,456 A * 6/1997 Perrone ..... 124/76
6,101,918 A * 8/2000 Akins ..... 89/129.01
7,077,117 B1 * 7/2006 Chu ..... 124/32
7,305,980 B2 * 12/2007 Liao ..... 124/31
7,588,023 B2 * 9/2009 Kung et al. ..... 124/27
7,634,959 B2 * 12/2009 Frickey ..... 89/136
7,878,106 B2 * 2/2011 Hu ..... 89/129.02
8,051,847 B2 * 11/2011 Hu ..... 124/73
8,146,576 B2 * 4/2012 Hu ..... 124/31
8,156,930 B2 * 4/2012 Hu ..... 124/71
8,225,705 B2 * 7/2012 Dubois et al. ..... 89/140
8,567,379 B2 * 10/2013 Hu ..... 124/60
8,585,407 B2 * 11/2013 Hu ..... 434/18
2010/0095833 A1 * 4/2010 Gavage et al. ..... 89/140
2010/0229843 A1 * 9/2010 Hu ..... 124/80
2011/0041825 A1 * 2/2011 Hu ..... 124/71
2011/0146647 A1 * 6/2011 Hu ..... 124/76
2011/0174283 A1 * 7/2011 Hu ..... 124/31
2012/0048253 A1 * 3/2012 Hu ..... 124/73
2013/0087130 A1 * 4/2013 Hu ..... 124/60

* cited by examiner

*Primary Examiner* — Michael David
(74) *Attorney, Agent, or Firm* — Rosenberg, Klein & Lee

(57) ABSTRACT

A firearm firing mechanism is so configured that a hammer is retained by a front retaining block before pressing a trigger; pressing the trigger slightly at a first stage causes a main bar to bias a rear retaining block and the front retaining block backwardly at a relatively smaller angle to release the hammer in performing a single-shot action; pressing the trigger heavily at a second stage causes the main bar at a relatively longer distance so that the hammer is kept away from the front retaining block when it is returned, and the hammer is secured by the rear retaining block upon a backward displacement of a bolt and backward biasing of the hammer, and a linkage is forced to move the rear retaining block in releasing the hammer for firing when the bolt is forward again, and a continuous multi-shot firing action is performed by means of repeating this operation.

13 Claims, 12 Drawing Sheets

FIREARM FIRING SYSTEM

BACKGROUND OF THE INVENTION

1. Field of the Invention

The present invention relates to firearm technology, and more particularly to a firearm system, which allows the trigger to be pressed slightly at a first stage to perform a single-shot firing action, or heavily at a second state to perform a continuous multi-shot firing action.

2. Description of the Prior Art

A large firearm generally provides a single-shot firing mode and a continuous multi-shot firing mode for section. Taiwan Patent Number 334844, Number M360726 (equivalent to China Patent Number ZL200920006985.3 or U.S. Pat. No. 7,878,196), and Number M371871 disclose similar designs.

The aforesaid prior art designs commonly comprise a bolt, a hammer, a trigger, a hammer hook, a multi-shot control bar, and a switch. The switch is located at one side of the gun body, providing a switching lever. The gun body has an axle mounted therein. The axle provides a groove configured to match with the hammer hook, the multi-shot control bar, a ratchet wheel and a pawl to fit the operation of the trigger in performing a single-shot firing action or continuous multi-shot firing action.

However, the arrangement of the switch, the axle, and the switching lever complicates the structure of the firearm. During operation to select the single-shot or continuous multi-shot firing mode, the user must bias the switching lever to shift the position of the groove of the axle.

Further, Taiwan Patent Number M383111 (equivalent to China Patent Number ZL200920174472.3, U.S. Pat. No. 8,146,576 or European Patent Number 2,392,888) also discloses a firing actuator mechanism that provides a single-shot firing mode and a continuous multi-shot firing mode. However, the user must operate a selector block to switch between the single-shot firing mode and the continuous multi-shot firing mode.

Furthermore, there is another design that has a rotary wheel provided at the bottom side of the trigger and rotatable to switch between a single-shot firing mode and a continuous multi-shot firing mode. However, the installation of the rotary wheel complicates the structural design. Further, the user must rotate the rotary wheel to select between the single-shot firing mode and the continuous multi-shot firing mode.

Therefore, there is a strong demand for a firearm firing system providing a single-shot firing mode and a continuous multi-shot firing mode that has a simple structure and is convenient to operate.

SUMMARY OF THE INVENTION

The present invention has been accomplished under the circumstances in view. It is one object of the present invention to provide a firearm firing system, which has a simple structural design that enhances the operation convenience in achieving single-shot and multi-shot firing actions.

To achieve this and other objects of the present invention, a firearm firing system, comprises a bolt, a hammer, a trigger, a rear retaining block and a front retaining block. The hammer comprises a side retaining lug located at a top side thereof and a hook located at a bottom side thereof. The trigger has a rod member pivotally connected to a top side thereof. The rear retaining block comprises a hook portion at one lateral side thereof. The front retaining block comprises a protruding portion located at a front side thereof. The hook of the hammer is hooked on the protruding portion of the front retaining block when the trigger is not pressed. The trigger is pressable to move the rod member forward and to further cause disengagement of the hook of the hammer from the protruding portion of the front retaining block, enabling the hammer to strike forward. The bolt is moved back to return the hammer and to force the side retaining lug of the hammer into engagement with the hook portion of the rear retaining block after the bullet-striking action of the hammer, and then the bolt is immediately moved forward after engagement between the side retaining lug and the hook portion. The rod member is moved back and the side retaining lug of the hammer is disengaged from the hook portion of the rear retaining block, and the hook of the hammer is forced into engagement with the protruding portion of the front retaining block after the trigger is released. The invention is characterized in that the rear retaining block further comprises a stub rod located at an opposite lateral side thereof; the front retaining block further comprises a top abutment portion; the firearm firing system further comprises a main bar having a front end thereof pivotally connected to the rod member; the main bar comprises a retaining portion located at a bottom side of an opposing rear end thereof; the retaining portion has a rear side stopped against the stub rod of the rear retaining block and a front side stopped against the top abutment portion of the front retaining block; the main bar is moved backward to bias the rear retaining block and the front retaining block backward for enabling the side retaining lug of the hammer to be hooked on the hook portion of the rear retaining block when the trigger is pressed to move the rod member forward; the rod member forces the main bar to bias the rear retaining block and the front retaining block forward when the trigger is released, causing the side retaining lug of the hammer to be disengaged from the hook portion of the rear retaining block and the hammer to move the hook into engagement with the protruding portion of the front retaining block.

Further, the main bar comprises a rear top edge located at an opposing top side of the rear end, a recessed portion located at the top side of the rear end near said rear top edge, and a bevel edge located at the top side of the rear end and connected between the rear top edge and the recessed portion. The bevel edge has a relatively lower front side and a relatively higher rear side connected to the rear top edge. The firearm firing system further comprises a linkage disposed at an inner side relative to the main bar. The linkage comprises a front link and a rear link pivotally connected in line. The front link comprises a top lug. The rear link suspends above the rear retaining block, comprising a rear abutment portion and a bottom push portion. The rear abutment portion is disposed at the rear top edge of the main bar when the trigger is not pressed. The rear retaining block comprises an engagement portion disposed below the bottom push portion of the rear link.

Further, the rear abutment portion of the rear link is disposed at the bevel edge of the main bar when the trigger is pressed to move the main bar backward in performing a single-shot firing action. The top lug of the front link is forced by the bolt to move the linkage forward, and the bottom push portion of the rear link is kept away from the rear retaining block during a forward displacement of the bolt.

Further, the rear abutment portion of the rear link is disposed at the recessed portion of the main bar when the trigger is pressed to move the main bar backward in performing a continuous multi-shot firing action. The top lug of the front link is forced by the bolt to move the linkage forward and the bottom push portion of the rear link is forced to push the rear retaining block and to further force the hook portion of the rear retaining block away from the side retaining lug for enabling the hammer to be returned upon a forward displacement of the bolt. The hook of the hammer is kept away from the protruding portion of the front retaining block when the hammer is returned.

Preferably, the linkage further comprises a spring member stopped against one end of the rear link opposite to the front link of the linkage for returning the linkage after the linkage having been moved forward.

Preferably, the firearm firing system further comprises a follower block supported on a pressure ball to press on a rear side of the front retaining block in such a manner that when the trigger is pressed to move the main bar backward, the front retaining block is forced to push follower block backward, and the follower block is forced to impart a pressure to the pressure ball during a backward displacement of the main bar to perform a continuous multi-shot firing action.

Preferably, the follower block comprises a bevel portion disposed at the rear side thereof and kept in contact with the pressure ball, and adapted to impart a pressure to the pressure ball upon a backward movement of the front retaining block to push the follower block.

In general, the invention provides a firearm firing system so configured that when the user presses the trigger slightly at the first stage or heavily at the second stage, the main bar will be moved backward at a different distance to bias the rear retaining block and the front retaining block at a different biasing angle, driving the bolt to carry the link forward in or without moving the rear retaining block forward. Thus, when the hammer is returned, it will be forced into engagement with the rear retaining block and the front retaining block at a different condition to achieve a single shot firing action or multi-shot firing action without any other switching operation. Thus, the invention facilitates firearm firing operation and eliminates the operation drawbacks of conventional designs, and the value of the firearm constructed in accordance with the present invention is greatly enhanced.

Other advantages and features of the present invention will be fully understood by reference to the following specification in conjunction with the accompanying drawings, in which like reference signs denote like components of structure.

DETAILED DESCRIPTION OF THE PREFERRED EMBODIMENT

Figure 1:
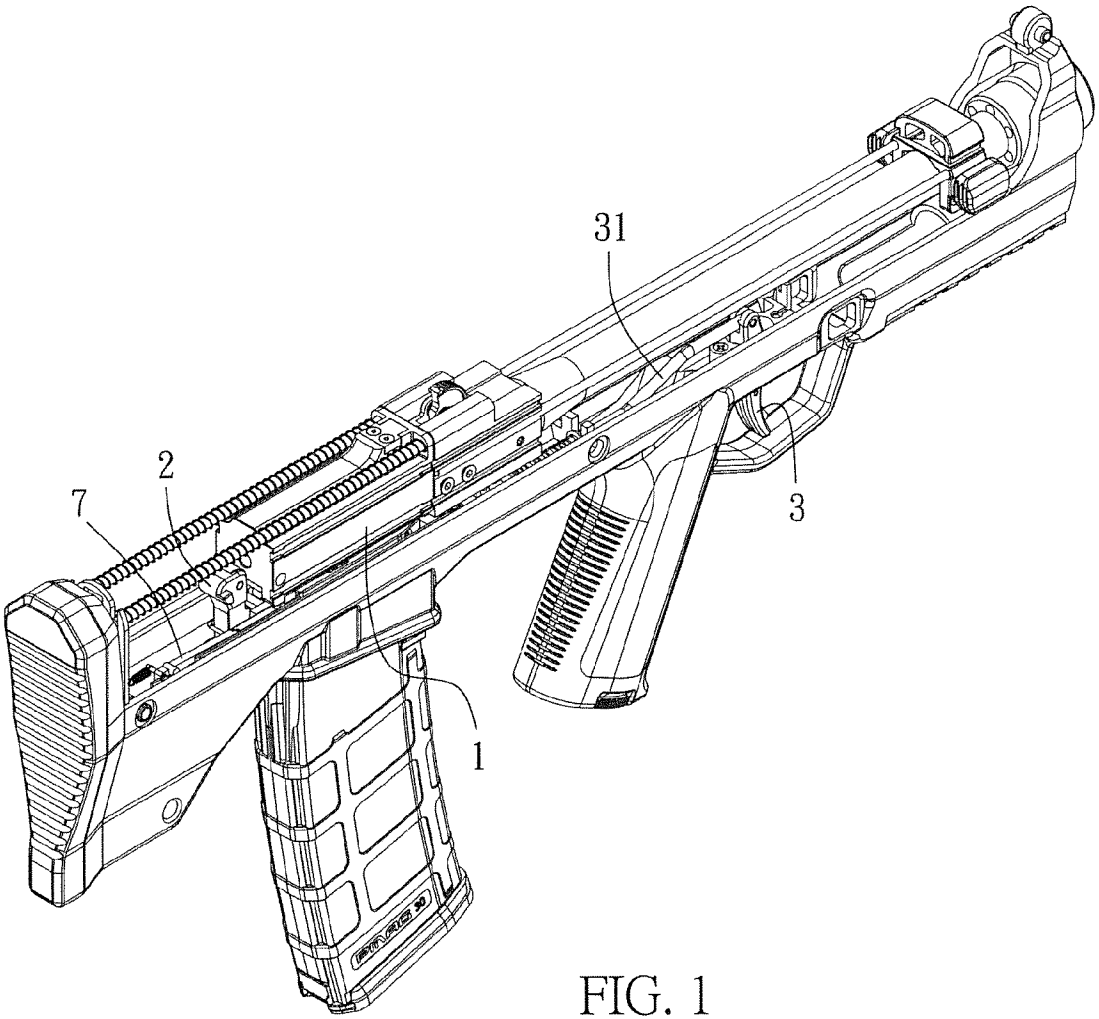
FIG. 1 is an elevational view illustrating firearm equipped with firing system in accordance with the present invention.
Figure 2:
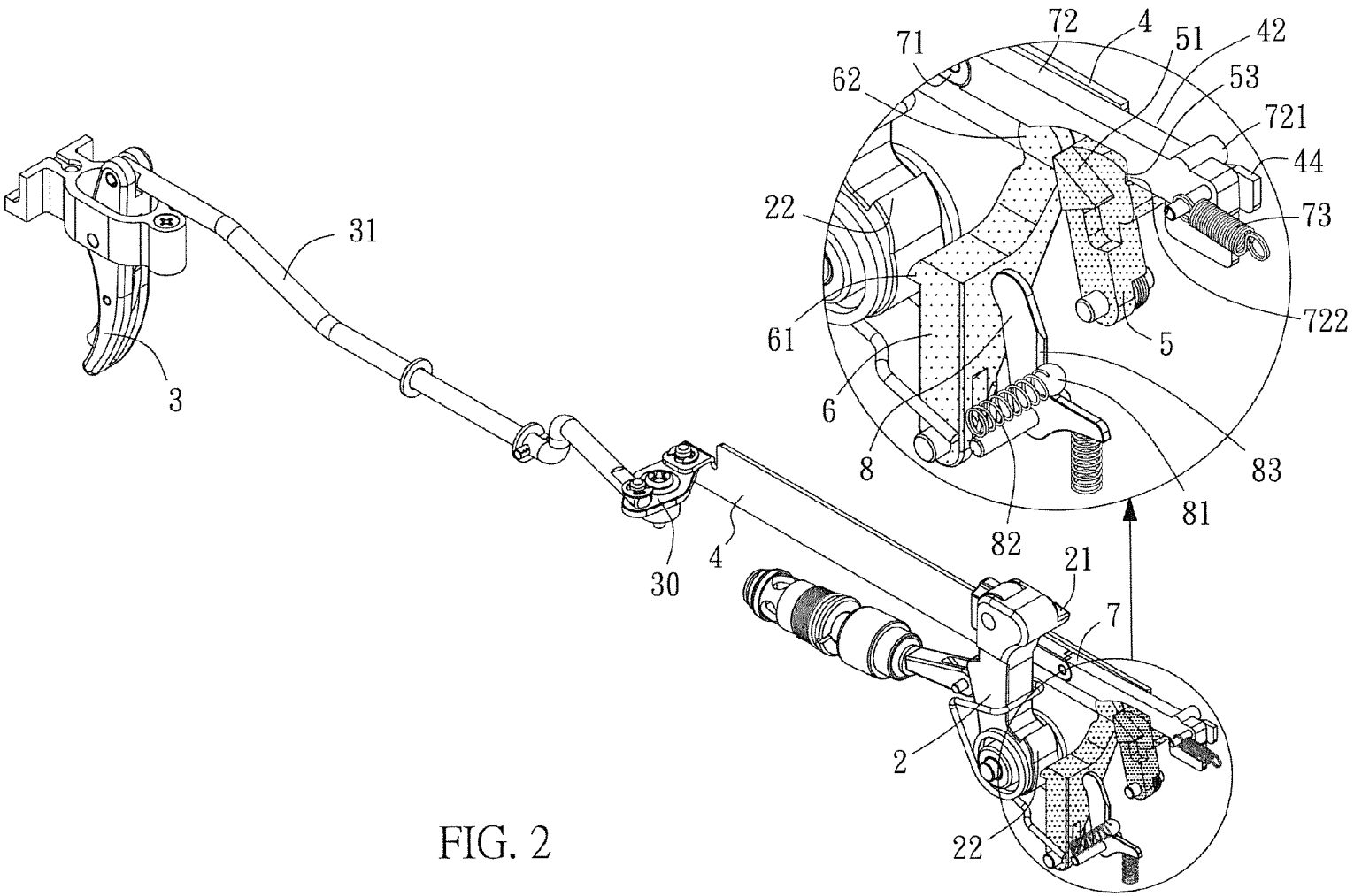
FIG. 2 is an elevational view of the firing system shown in FIG. 1 and an enlarged view of a part of the firing system.
Figure 3:
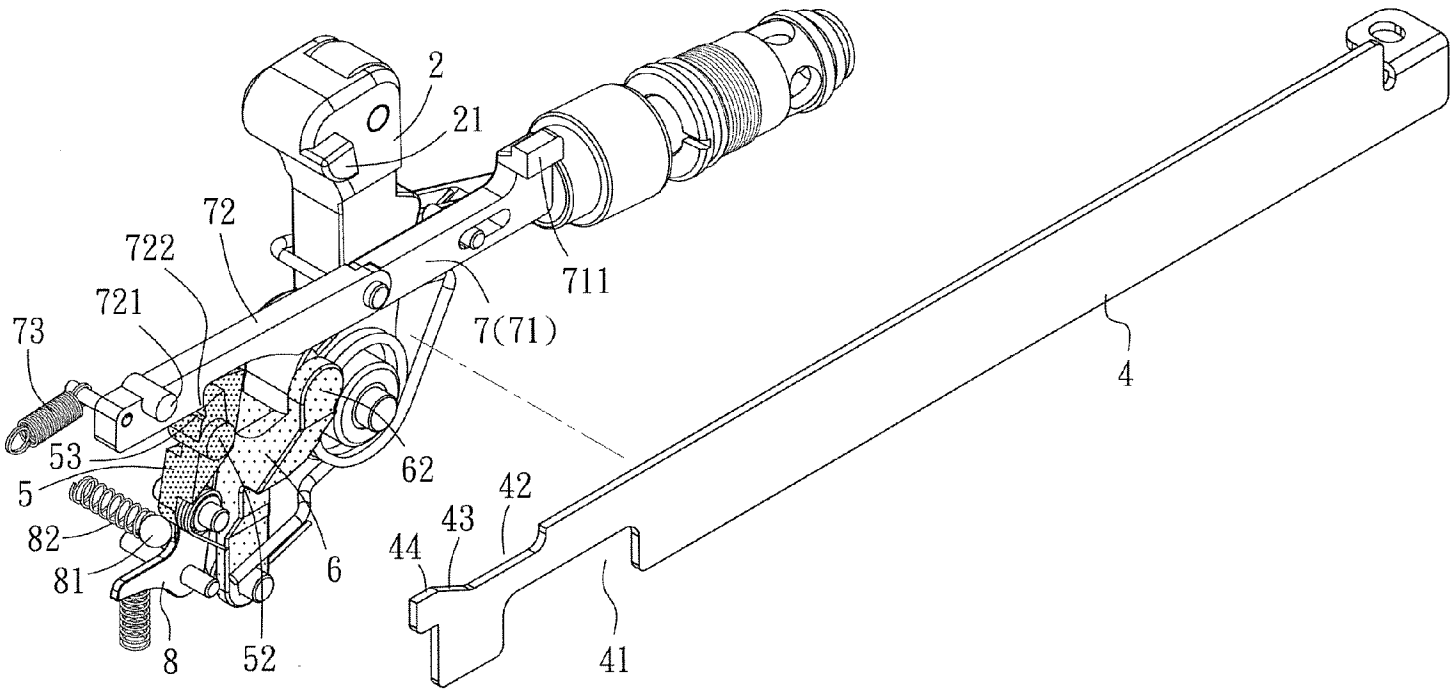
FIG. 3 is an exploded view of the firing system in accordance with the present invention.

Referring to FIGS. 1-3, a firearm firing system used in a firearm in accordance with the present invention is shown comprising a bolt 1, a hammer 2, a trigger 3, a main bar 4, a rear retaining block 5, a front retaining block 6, a linkage 7, and a follower block 8.

The bolt 1 will be moved forward upon a firing operation, and then immediately moved back to preserve a forward return force subject to the effect of a compressed intake gas.

The hammer 2 comprises a side retaining lug 21 located at a top side thereof and a hook 22 located at a bottom side thereof. When the bolt 1 is moved backward, it presses the hammer 2, causing the hammer 2 to preserve a forward return force. When the user presses the trigger 3, the hammer 2 is released from the constraint to drop, thereby firing the bullet.

The trigger 3 comprises a rod member 31 pivotally connected to a top side thereof (see FIG. 2), and a swivel connector 30 pivotally coupled between a distal end of the rod member 31 and one end of the main bar 4. When the user presses the trigger 3, the rod member 31 is moved forward. On the contrary, when the user releases the trigger 3, the rod member 31 is moved backward to its former position. Further, the distal end of the rod member 31 is pivotally connected to one side of the swivel connector 30.

The main bar 4 has a front end thereof pivotally connected to an opposite side of the swivel connector 30 (see FIG. 2). When the user presses the trigger 3, the rod member 31 is moved forward, causing the swivel connector 30 to move the main bar 4 backward. On the contrary, when the user releases the trigger 3, the rod member 31 is moved backward, causing the swivel connector 30 to move the main bar 4 forward. The main bar 4 comprises a retaining portion 41 made in the form of a bottom-open notch and located at a bottom side of an opposing rear end thereof (see FIG. 3), a rear top edge 44 located at an opposing top side of the rear end, a recessed portion 42 located at the top side of the rear end near the rear top edge 44, and a bevel edge 43 located at the top side of the rear end and connected between the rear top edge 44 and the recessed portion 42. The bevel edge 43 has a relatively lower front side connected to the recessed portion 42, and a relatively higher rear side connected to the rear top edge 44.

Figure 8:
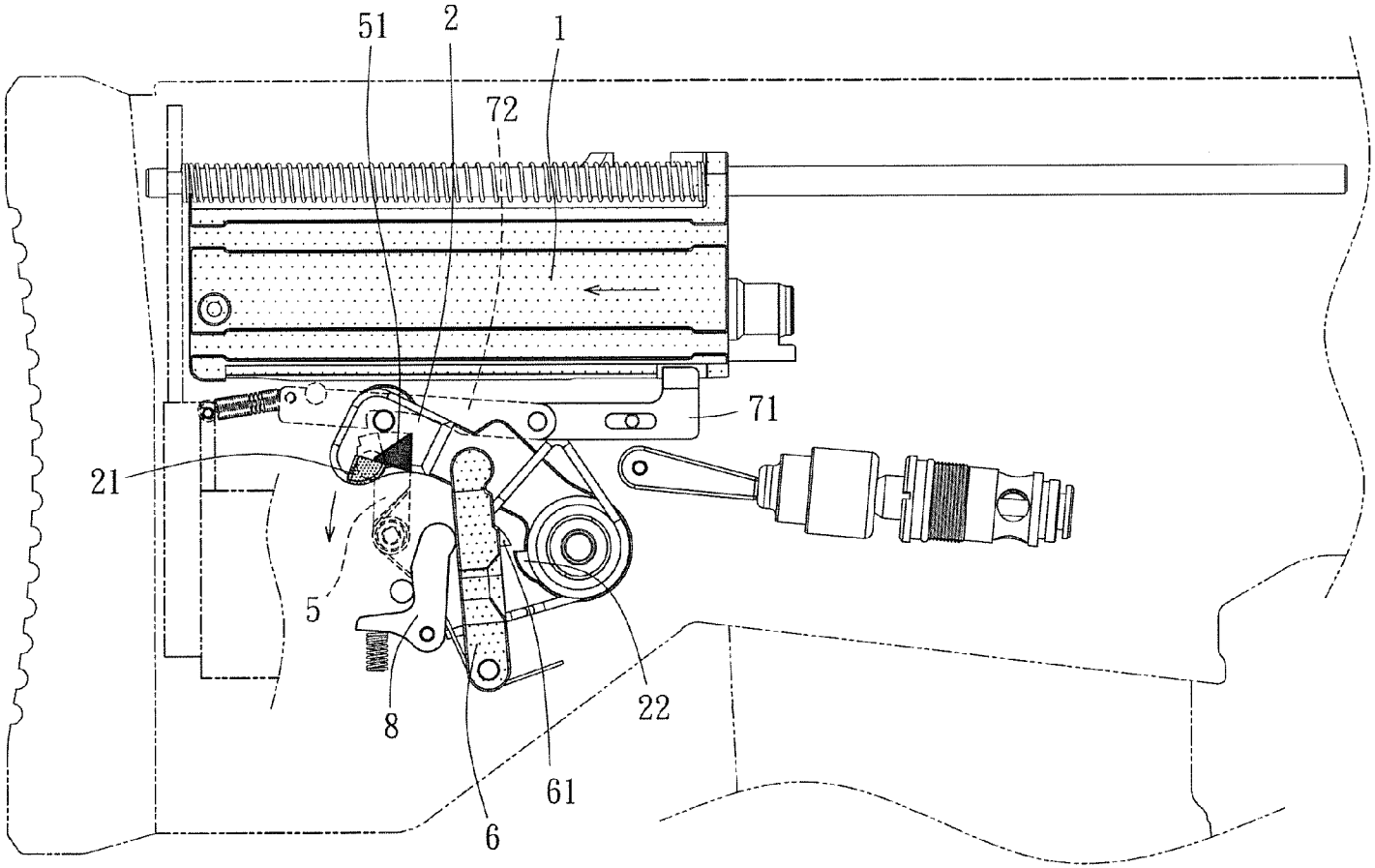
FIG. 8 corresponds to FIG. 7, illustrating the bolt moved backward after triggering of the trigger.

The rear retaining block 5 has a bottom end thereof pivotally mounted in the firearm, and is capable of providing a backward-basing return force. The rear retaining block 5 comprises a hook portion 51 located one lateral side of an opposing top end thereof (see FIG. 2), a stub rod 52 located an opposite lateral side of the top end (see FIG. 3), and an engagement portion 53 located at a rear side of the top end. When the hammer 2 is biased backward, the side retaining lug 21 of the hammer 2 will be forced into engagement with the hook portion 51 of the rear retaining block 5 (see FIG. 8), and the stub rod 52 of the rear retaining block 5 will be pressed on a rear end of the retaining portion 41 of the main bar 4 (see FIG. 4). Thus, when the main bar 4 is moved backward, the rear retaining block 5 will be turned backward.

The front retaining block 6 has a bottom end thereof pivotally mounted in the firearm and is capable of providing a forward-basing return force. The front retaining block 6 comprises a protruding portion 61 located at a front side thereof, and a top abutment portion 62 located at an opposing top end thereof. The top abutment portion 62 is forwardly abutted against an opposing front end of the retaining portion 41 of the main bar 4 (see FIG. 4). Thus, when the main bar 4 is moved backward, the front retaining block 6 will be forced to bias backward and to preserve a forward return force; when the main bar 4 is moved forward, the side retaining lug 21 of the hammer 2 will be released from the hook portion 51 of the rear retaining block 5, and the hook 22 of the hammer 2 will be forced into engagement with the protruding portion 61 of the front retaining block 6 when the hammer 2 is moved back (see FIGS. 4 and 5).

Figure 6:
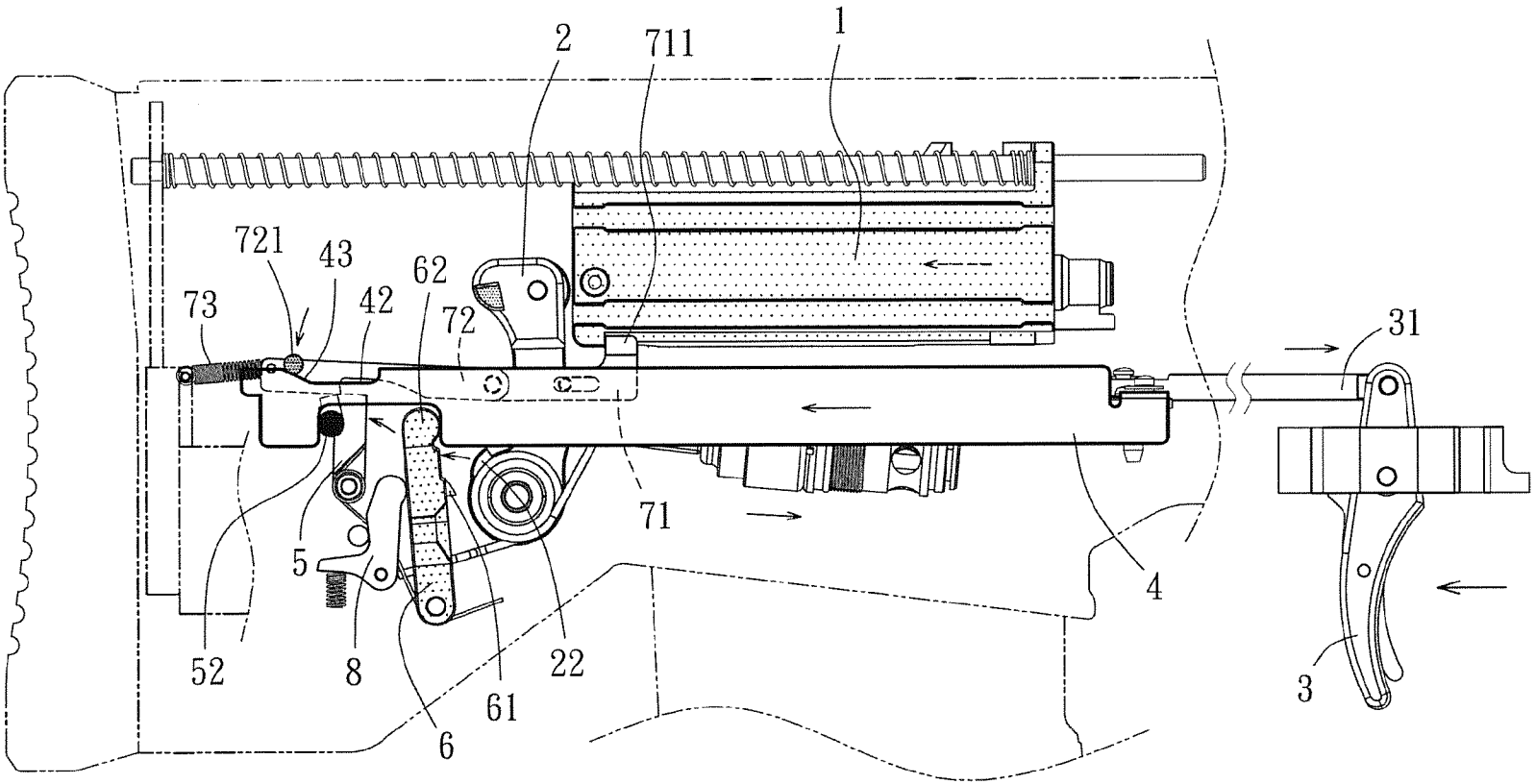
FIG. 6 is a schematic plain view of the present invention, illustrating the status of the firearm firing system when the trigger is pressed slightly at a first stage.
Figure 7:
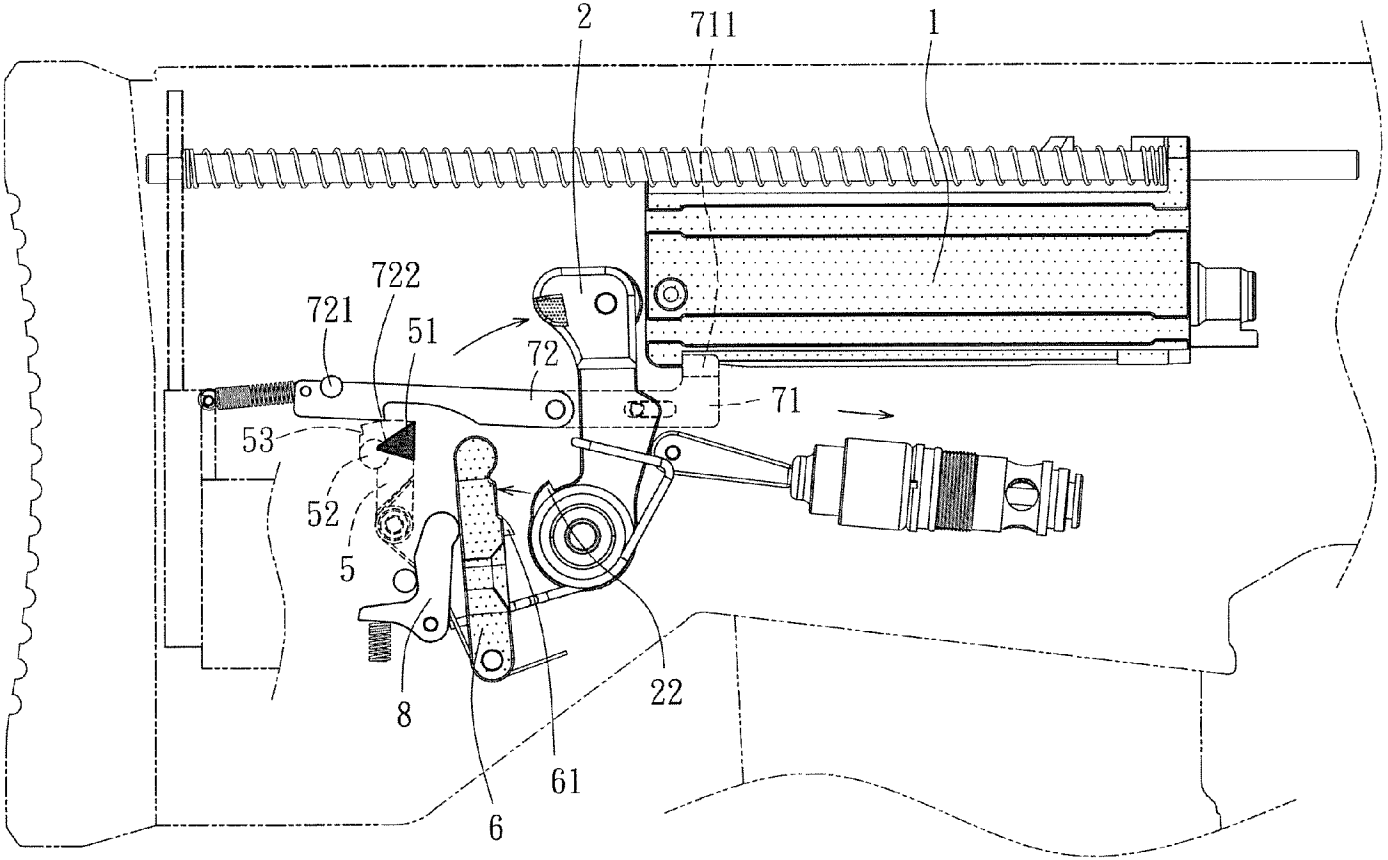
FIG. 7 is an enlarged view of a part of FIG. 6.
Figure 12:
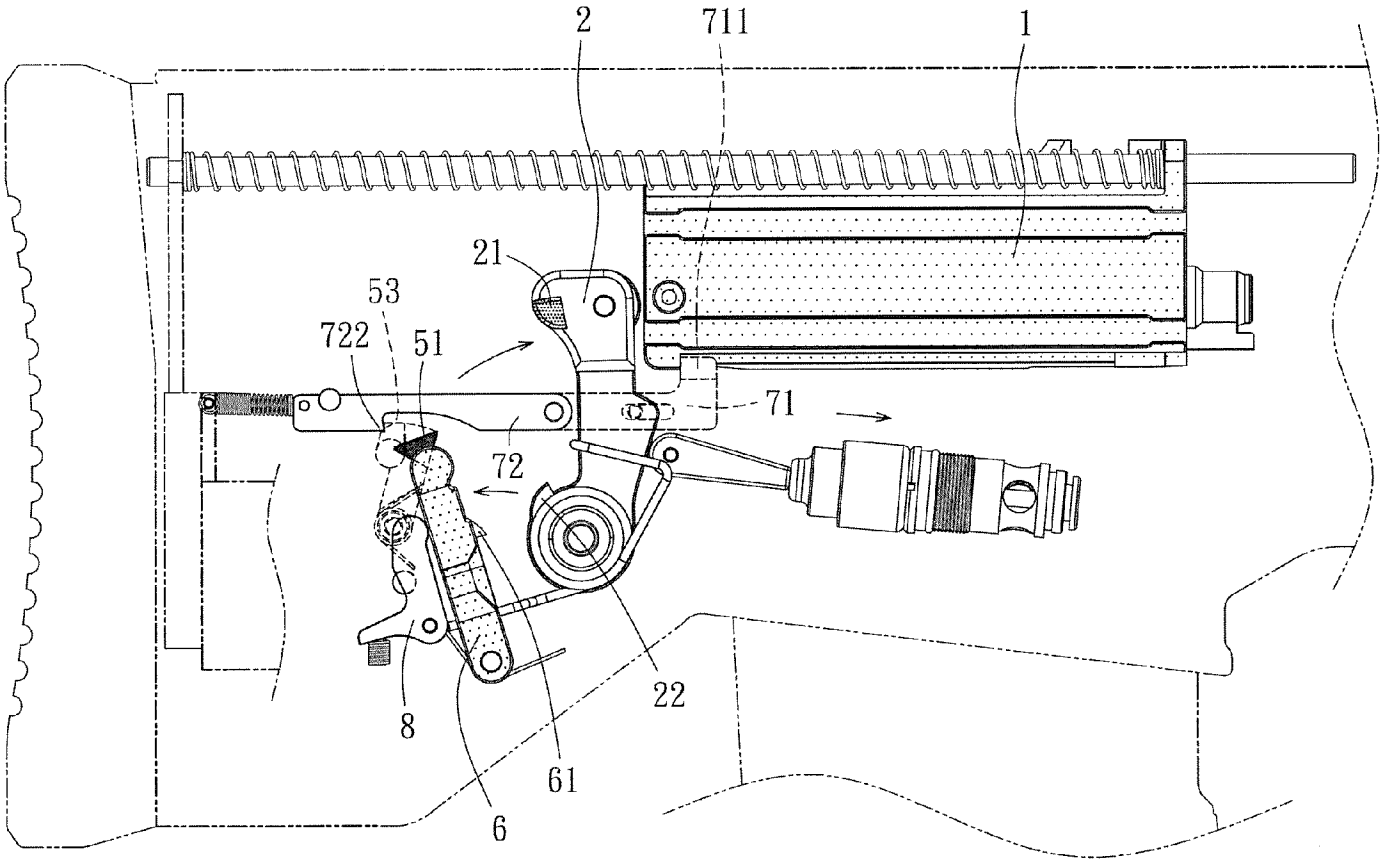
FIG. 12 corresponds to FIG. 11, illustrating the bolt moved forward.

The linkage 7 is mounted at an inner side relative to the main bar 4, comprising a front link 71 having opposing front and rear ends, a rear link 72 having a front end thereof pivotally connected to the rear end of the front link 71 (see FIGS. 3 and 4), and a spring member 73 provided at an opposing rear end of the rear link 72. The front link 71 has a top lug 711 located at the front end thereof remote from the rear link 72. When the bolt 1 is moved forward, it will hook on the top lug 711 to push the linkage 7 forward. The rear link 72 has the rear end thereof connected to the spring member 73. The spring member 73 is adapted to pull back the linkage 7 after the linkage 7 having been pushed forward. Further, the rear end of the rear link 72 is suspending above the rear retaining block 5. Further, the rear link 72 has a rear abutment portion 721 located at the rear end thereof. When the trigger 3 is not pressed, the rear abutment portion 721 will be moved to the rear top edge 44 of the main bar 4 (see FIG. 4). Pressing the trigger 3 slightly at a first stage to move the main bar 4 backward in a relatively shorter distance in performing a single-shot operation, the rear abutment portion 721 will be moved to the bevel edge 43 of the main bar 4 (see FIG. 6). The rear link 72 further has a push portion 722 located at a bottom side thereof and disposed above the engagement portion 53 of the rear retaining block 5 (see FIG. 7), i.e., moving the linkage 7 forward or backward does not cause the rear retaining block 5 to bias. Pressing the trigger 3 heavily at a second stage to move the main bar 4 backward in a relatively longer distance in performing a multi-shot operation, the rear abutment portion 721 will be moved to the recessed portion 42 of the main bar 4 (see FIG. 10). At this time, the push portion 722 of the rear link 72 is moved to the rear side of the engagement portion 53 of the rear retaining block 5 (see FIG. 12). When the bolt 1 is moved forward at this time, it will hook on the top lug 711 to push the linkage 7 forward, causing the push portion 722 of the rear link 72 to push the rear retaining block 5 to the position where the hook portion 51 of the rear retaining block 5 is disengaged from the side retaining lug 21 of the hammer 2, and thus the hammer 2 can be returned. Further, because the backward stroke of the main bar 4 is relatively longer at this time, the front retaining block 6 can be biased through a relatively larger angle. Thus, the hook 22 is kept away from the protruding portion 61 when the hammer 2 is pressed and then returned.

The follower block 8 is forwardly and elastically pressed on the rear side of the front retaining block 6, having a pressure member, for example, pressure ball 81 attached to a rear side thereof (see FIG. 2) and supported on an elastic member 82. Further, the follower block 8 has a bevel portion 83 defined in the rear side thereof. When pressing the trigger 3 to move the main bar 4 backward, the front retaining block 6 will be forced to push the follower block 8 backward. Further, when pressing the trigger 3 heavily at the second stage to move the main bar 4 backward in a relatively longer distance in performing a multi-shot operation, the bevel portion 83 of the follower block 8 will be forced against the pressure ball 81 to compress the elastic member 82. At this time, the trigger 3 receives a pressure from the follower block 8, giving a warning signal to the user pressing the trigger 3 to prevent an accidental heavy pressing operation.

Figure 4:
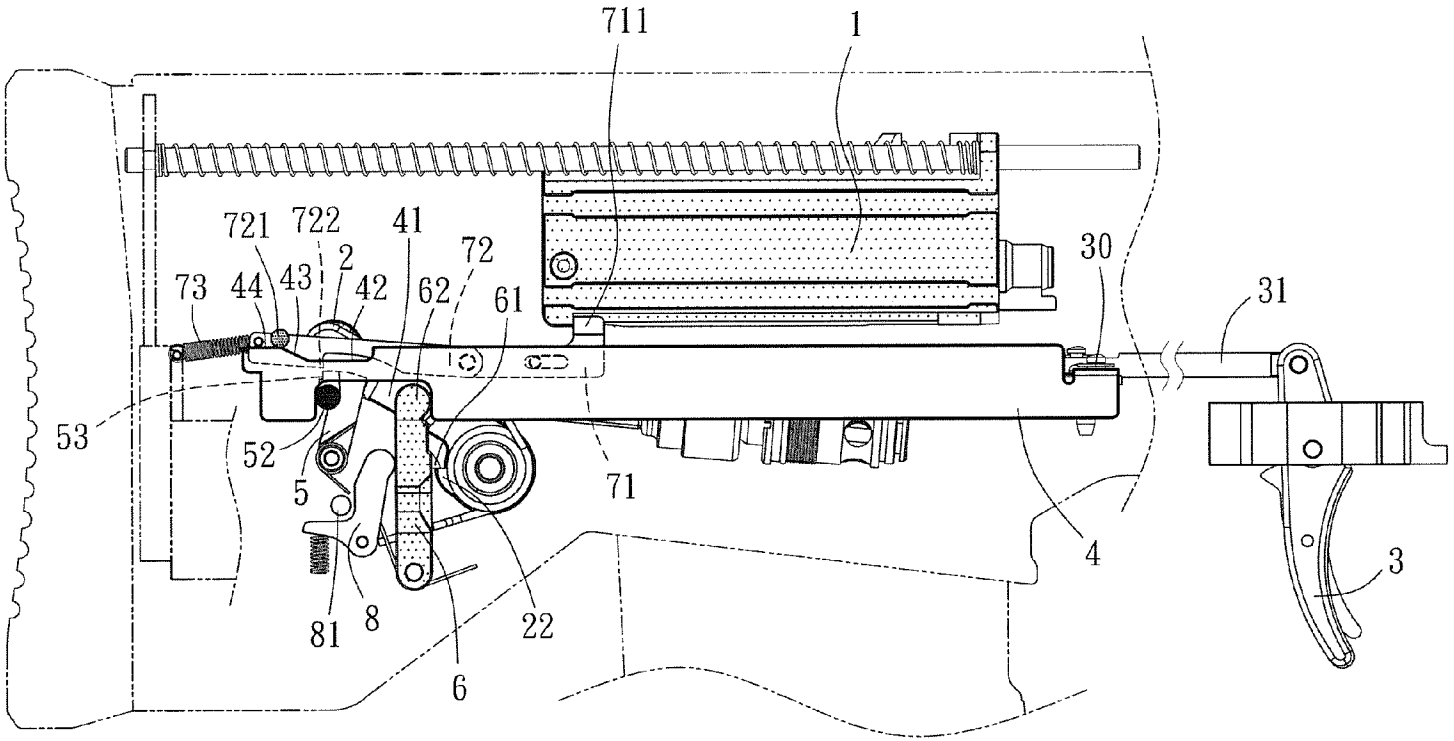
FIG. 4 is a schematic plain view of the present invention, illustrating the status of the firearm firing system when the trigger is not pressed.
Figure 5:
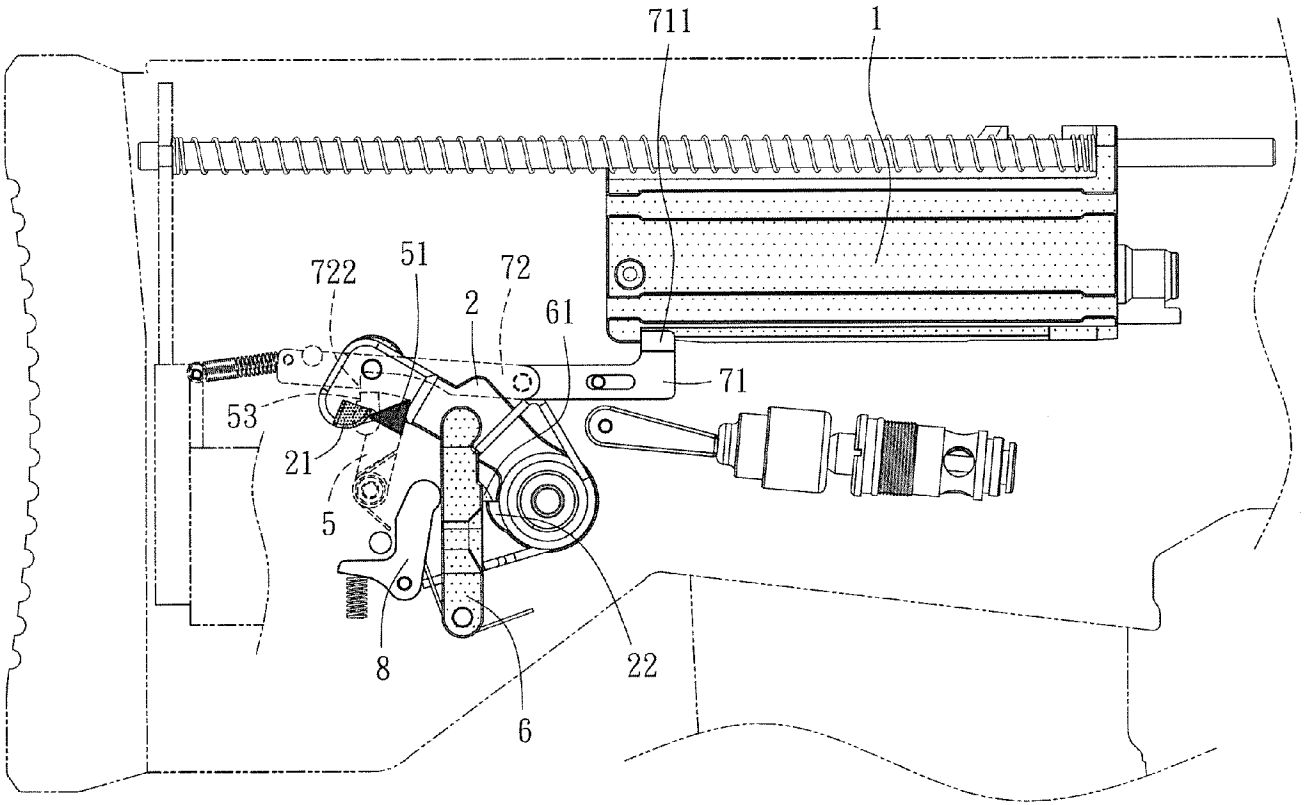
FIG. 5 is an enlarged view of a part of FIG. 4.
Figure 9:
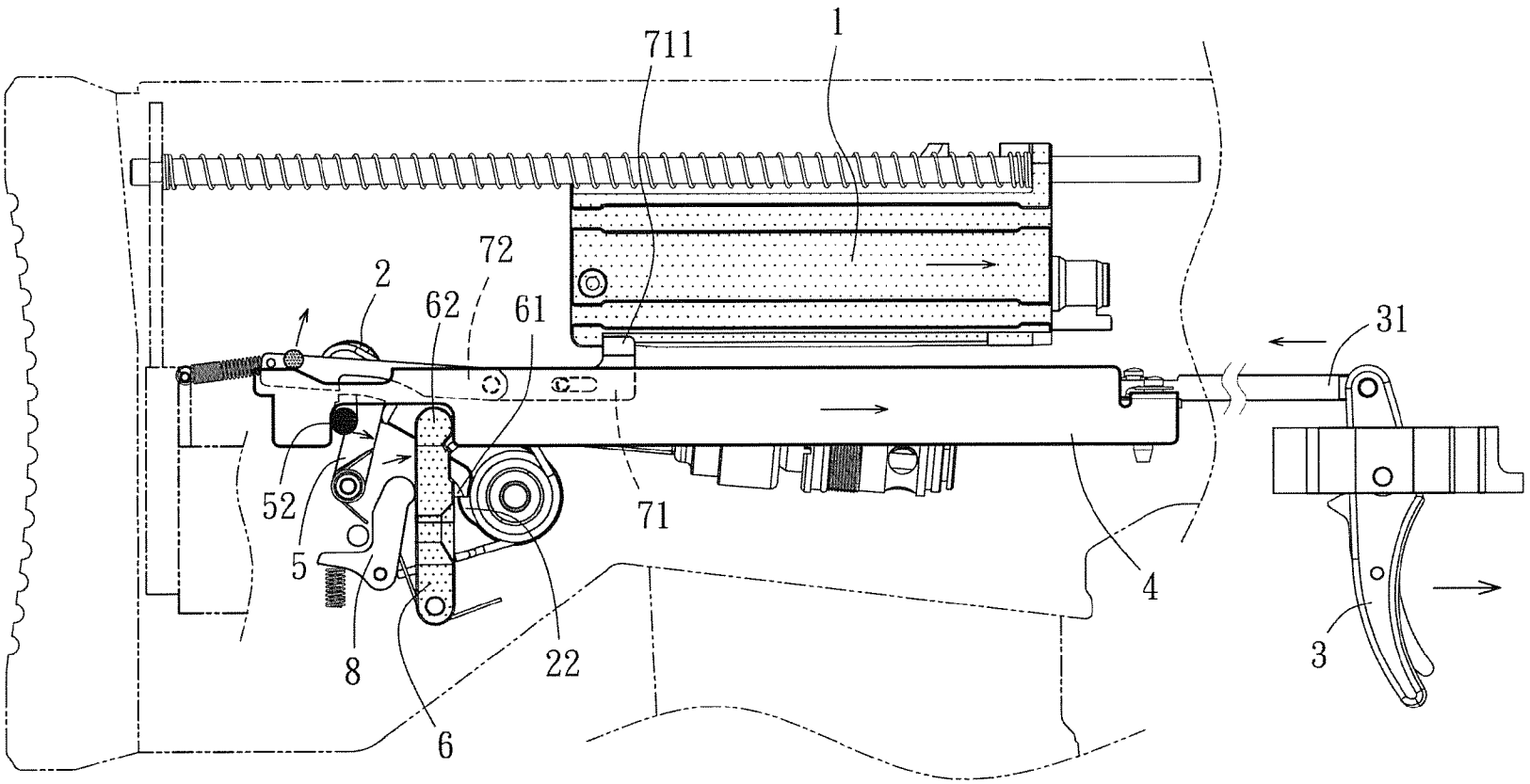
FIG. 9 corresponds to FIG. 8, illustrating the bolt moved forward again.

Thus, when the trigger 3 is not pressed, the hook 22 of the hammer 2 is secured to the protruding portion 61 of the front retaining block 6 (see FIG. 4). When the trigger 3 is slightly pressed at the first stage (see FIGS. 6 and 7), the main bar 4 is moved backward to disengage the hook 22 from the protruding portion 61 of the front retaining block 6, enabling the hammer 2 to strike forward, and the bolt 1 is then moved back subject to the effect of a compressed intake gas. At this time, the back stroke of the main bar 4 is short, and a single-shot firing action is performed, causing the rear abutment portion 721 to be stopped at the bevel edge 43 of the main bar 4 (see FIG. 6) and the rear retaining block 5 and the front retaining block 6 to be moved backward with the main bar 4. After the backward displacement of the bolt 1, the side retaining lug 21 of the hammer 2 is forced into engagement with the hook portion 51 of the rear retaining block 5 (see FIG. 8). Thereafter, the user releases the trigger 3, allowing the main bar 4 to be moved forward to its former position (see FIG. 9). At this time, the rear retaining block 5 and the front retaining block 6 swing forward, causing the hook portion 51 to be disengaged from the side retaining lug 21 of the hammer 2 (see also FIG. 8), and thus the hammer 2 swings forward immediately. After the hammer 2 swings back, the hook 22 of the hammer 2 is immediately hooked on the protruding portion 61 to the standby position (see FIGS. 4 and 9) for a nest firing operation. This is the performance of a single-shot firing action.

Figure 10:
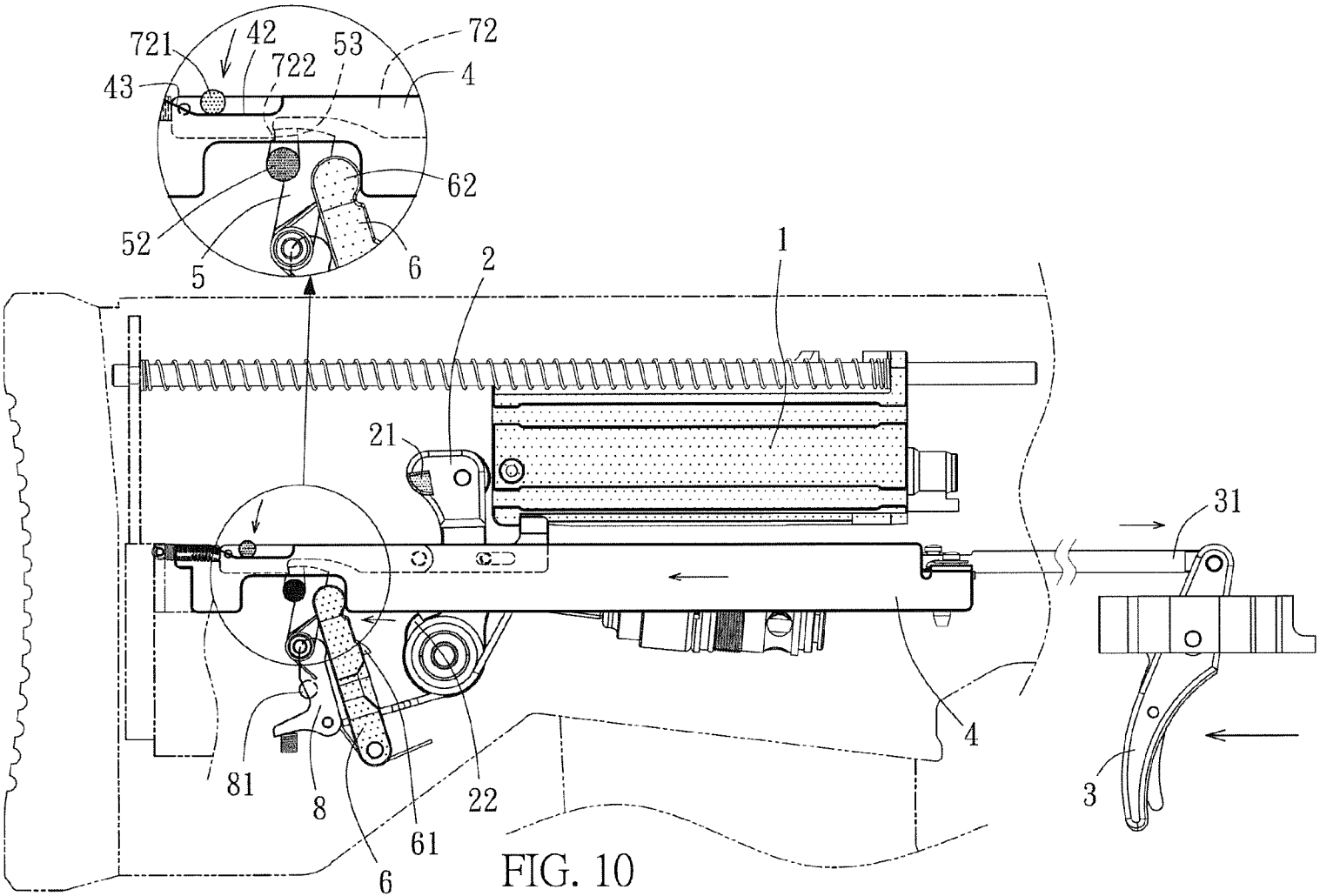
FIG. 10 is a schematic plain view and an enlarged partial view of the present invention, illustrating the status of the firearm firing system when the trigger is pressed heavily at a second stage.
Figure 11:
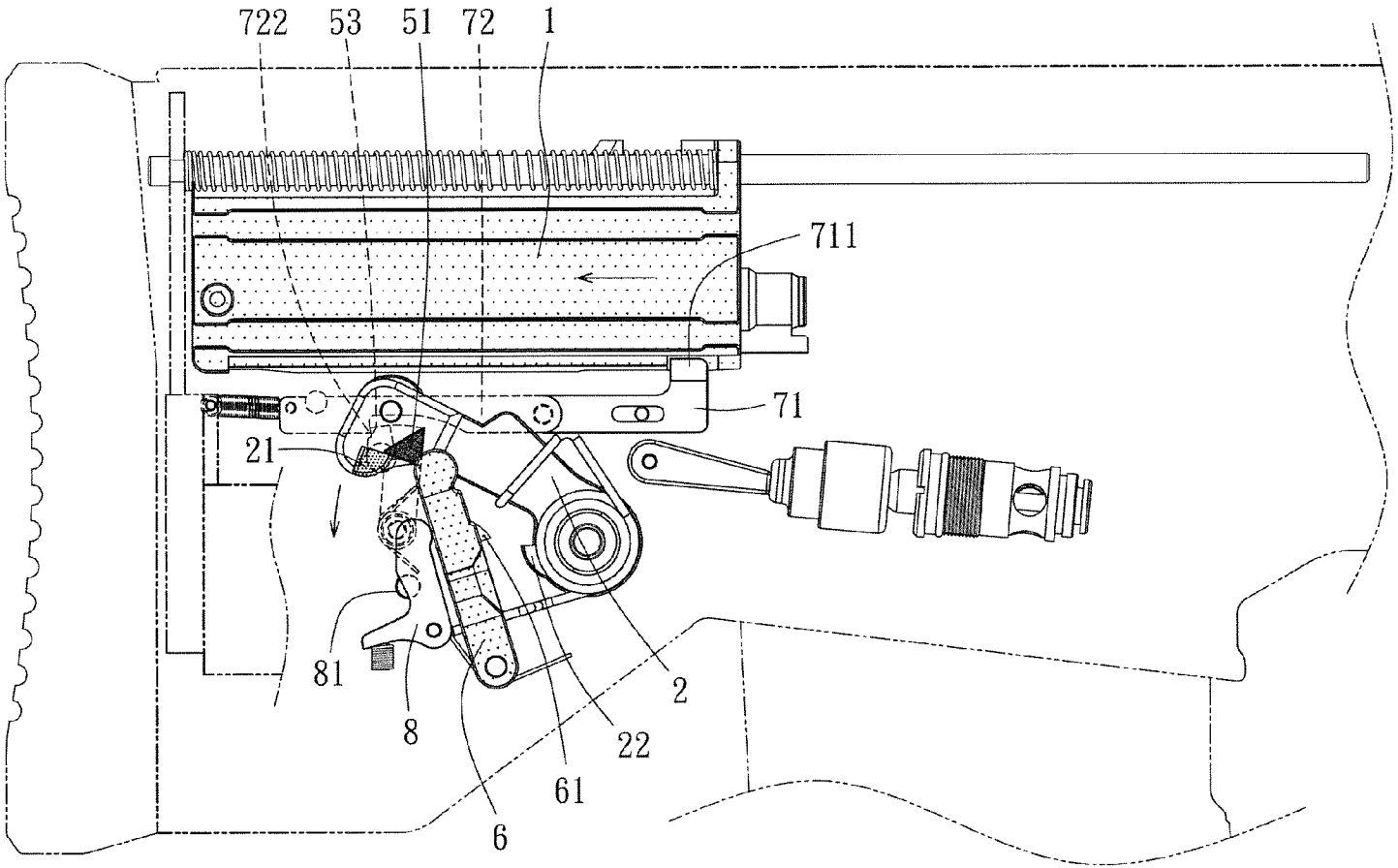
FIG. 11 is an enlarged view of a part of FIG. 10.

When the trigger 3 is heavily pressed at the second stage (see FIG. 10), the main bar 4 is moved backward at a relatively longer distance, causing the front retaining block 6 to push the follower block 8 backwardly against the pressure ball 81 and the elastic member 82 (see FIGS. 2 and 10). At this time, the user's finger feels a pressure, and thus, a warning effect is established. At this time, the rear abutment portion 721 is shifted from the bevel edge 43 to the recessed portion 42 (see FIG. 10), causing the main bar 4 to bias the front retaining block 6 at a relatively larger swing angle (see FIGS. 6 and 10). At this time, the push portion 722 of the rear link 72 is disposed at the rear side of the engagement portion 53 of the rear retaining block 5. After backward displacement of the bolt 1 to force the hammer 2 backward, the side retaining lug 21 of the hammer 2 immediately hooks on the hook portion 51 of the rear retaining block 5 (see FIG. 11). Thereafter, the bolt 1 is moved forward to hook on the top lug 711 and to further move the linkage 7 forward (see FIG. 12). At the same time, the push portion 722 of the rear link 72 pushes the rear retaining block 5 to move the hook portion 51 of the rear retaining block 5 away from the side retaining lug 21 of the hammer 2 (see FIGS. 11 and 12), enabling the hammer 2 to move back at a rush, thereby firing a bullet (not shown). At this time, the hook 22 is kept away from the protruding portion 61. If the trigger 3 is kept heavily pressed, the bolt 1 will be moved backward to bias the hammer 2 again, enabling the hammer 2 to be biased back and forth to achieve a multi-shot firing action. The main bar 4 will be moved forward to the standby position only after the user releases the trigger 3.

As stated above, when the user presses the trigger 3 slightly at the first stage or heavily at the second stage, the main bar 4 will be moved backward at a different distance to bias the rear retaining block 5 and the front retaining block 6 at a different biasing angle, driving the bolt 1 to carry the link 7 forward in or without moving the rear retaining block 5 forward. Thus, when the hammer 2 is returned, it will be forced into engagement with the rear retaining block 5 and the front retaining block 6 at a different condition to achieve a single shot firing action or multi-shot firing action without any other switching operation. Thus, the invention facilitates firearm firing operation and eliminates the operation drawbacks of conventional designs, and the value of the firearm constructed in accordance with the present invention is greatly enhanced.

Although a particular embodiment of the invention has been described in detail for purposes of illustration, various modifications and enhancements may be made without departing from the spirit and scope of the invention. Accordingly, the invention is not to be limited except as by the appended claims.

What the invention claimed is:

1. A firearm firing system, comprising a bolt, a hammer, a trigger, a rear retaining block and a front retaining block, said hammer comprising a side retaining lug located at a top side thereof and a hook located at a bottom side thereof, said trigger having a rod member pivotally connected to a top side thereof, said rear retaining block comprising a hook portion at one lateral side thereof, said front retaining block comprising a protruding portion located at a front side thereof, said hook of said hammer being hooked on said protruding portion of said front retaining block when said trigger is not pressed, said trigger being pressable to move said rod member forward and to further cause disengagement of said hook of said hammer from said protruding portion of said front retaining block for enabling said hammer to strike forward, said bolt being moved back immediately to return said hammer and to force said side retaining lug of said hammer into engagement with said hook portion of said rear retaining block after the striking action of said hammer, and then said bolt being immediately moved forward after engagement between said side retaining lug and said hook portion, said rod member being moved back and said side retaining lug of said hammer being disengaged from said hook portion of said rear retaining block and said hook of said hammer being forced into engagement with said protruding portion of said front retaining block after said trigger is released; wherein:

said rear retaining block further comprises a stub rod located at an opposite lateral side thereof; said front retaining block further comprises a top abutment portion; the firearm firing system further comprises a main bar having a front end thereof pivotally connected to said rod member, said main bar comprising a retaining portion located at a bottom side of an opposing rear end thereof, said retaining portion having a rear side stopped against said stub rod of said rear retaining block and a front side stopped against said top abutment portion of said front retaining block, said main bar being moved backward to bias said rear retaining block and said front retaining block backward for enabling said side retaining lug of said hammer to be hooked on said hook portion of said rear retaining block when said trigger is pressed to move said rod member forward, said rod member forcing said main bar to bias said rear retaining block and said front retaining block forward when said trigger is released, causing said side retaining lug of said hammer to be disengaged from said hook portion of said rear retaining block and said hammer to move said hook into engagement with said protruding portion of said front retaining block.

2. The firearm firing system as claimed in claim 1, wherein said retaining portion of said main bar is bottom-open notch.

3. The firearm firing system as claimed in claim 1, wherein said main bar comprises a rear top edge located at an opposing top side of the rear end, a recessed portion located at the top side of the rear end near said rear top edge, and a bevel edge located at the top side of the rear end and connected between said rear top edge and said recessed portion, said bevel edge having a relatively lower front side and a relatively higher rear side connected to said rear top edge; the firearm firing system further comprises a linkage disposed at an inner side relative to said main bar, said linkage comprising a front link and a rear link pivotally connected in line, said front link comprising a top lug, said rear link suspending above said rear retaining block, said rear link comprising a rear abutment portion and a bottom push portion, said rear abutment portion being disposed at said rear top edge of said main bar when said trigger is not pressed; said rear retaining block comprises an engagement portion disposed below said bottom push portion of said rear link.

4. The firearm firing system as claimed in claim 1, wherein said main bar comprises a rear top edge located at an opposing top side of the rear end, a recessed portion located at the top side of the rear end near said rear top edge, and a bevel edge located at the top side of the rear end and connected between said rear top edge and said recessed portion, said bevel edge having a relatively lower front side and a relatively higher rear side connected to said rear top edge; the firearm firing system further comprises a linkage disposed at an inner side relative to said main bar, said linkage comprising a front link and a rear link pivotally connected in line, said front link comprising a top lug, said rear link suspending above said rear retaining block, said rear link comprising a rear abutment portion and a push portion, said rear abutment portion being disposed at said bevel edge of said main bar when said trigger is pressed to move said main bar backward in performing a single-shot firing action, said top lug of said front link being forced by said bolt to move said linkage forward and said bottom push portion of said rear link being kept away from said rear retaining block during a forward displacement of said bolt; said rear retaining block comprises an engagement portion disposed below said push portion of said rear link.

5. The firearm firing system as claimed in claim 4, wherein said linkage further comprises a spring member stopped against one end of said rear link opposite to said front link of said linkage for returning said linkage after said linkage having been moved forward.

6. The firearm firing system as claimed in claim 1, wherein said main bar comprises a rear top edge located at an opposing top side of the rear end, a recessed portion located at the top side of the rear end near said rear top edge, and a bevel edge located at the top side of the rear end and connected between said rear top edge and said recessed portion, said bevel edge having a relatively lower front side and a relatively higher rear side connected to said rear top edge; the firearm firing system further comprises a linkage disposed at an inner side relative to said main bar, said linkage comprising a front link and a rear link pivotally connected in line, said front link comprising a top lug, said rear link suspending above said rear retaining block, said rear link comprising a rear abutment portion and a bottom push portion, said rear abutment portion being disposed at said recessed portion of said main bar when said trigger is pressed to move said main bar backward in performing a continuous multi-shot firing action; said rear retaining block comprises an engagement portion disposed at a front side relative to said push portion of said rear link, said top lug of said front link being forced by said bolt to move said linkage forward and said bottom push portion of said rear link being forced to push said rear retaining block and to further force said hook portion of said rear retaining block away from said side retaining lug for enabling said hammer to be returned upon a forward displacement of said bolt, said hook of said hammer being kept away from said protruding portion of said front retaining block when said hammer is returned.

7. The firearm firing system as claimed in claim 6, wherein said linkage further comprises a spring member stopped against one end of said rear link opposite to said front link of said linkage for returning said linkage after said linkage having been moved forward.

8. The firearm firing system as claimed in claim 6, further comprising a follower block, said follower block being supported on a pressure ball to press on a rear side of said front retaining block in such a manner that when said trigger is pressed to move said main bar backward, said front retaining block is forced to push follower block backward; said follower block is forced to impart a pressure to said pressure ball during a backward displacement of said main bar to perform a continuous multi-shot firing action.

9. The firearm firing system as claimed in claim 8, wherein said follower block comprises a bevel portion located at the rear side thereof and kept in contact with said pressure ball and adapted to impart a pressure to said pressure ball upon a backward movement of said front retaining block to push said follower block.

10. The firearm firing system as claimed in claim 1, wherein said main bar comprises a rear top edge located at an opposing top side of the rear end, a recessed portion located at the top side of the rear end near said rear top edge, and a bevel edge located at the top side of the rear end and connected between said rear top edge and said recessed portion, said bevel edge having a relatively lower front side and a relatively higher rear side connected to said rear top edge; the firearm firing system further comprises a linkage disposed at an inner side relative to said main bar, said linkage comprising a front link and a rear link pivotally connected in line, said front link comprising a top lug, said rear link comprising a rear abutment portion and a bottom push portion, said rear abutment portion being disposed at said bevel edge of said main bar when said trigger is pressed to move said main bar backward in performing a single-shot firing action; said top lug of said front link being forced by said bolt to move said linkage forward and said bottom push portion of said rear link being kept away from said rear retaining block upon a forward displacement of said bolt; said rear retaining block comprises an engagement portion disposed below said bottom push portion of said rear link such that when said trigger is pressed to move said main bar backward to a distance larger than the moving distance in said single-shot firing action, said rear abutment portion is disposed at said recessed portion of said main bar and said bottom push portion is disposed at a rear side relative to said engagement portion; said bolt is moved forward, said bolt pushes said top lug of said front link to move said linkage forward, forcing said bottom push portion of said rear link to push said rear retaining block forward in moving said hook portion away from said side retaining lug of said hammer for enabling said hammer to be returned, said hook of said hammer being kept away from said protruding portion of said front retaining block when said hammer is returned.

11. The firearm firing system as claimed in claim 10, wherein said linkage further comprises a spring member stopped against one end of said rear link opposite to said front link of said linkage for returning said linkage after said linkage having been moved forward.

12. The firearm firing system as claimed in claim 10, further comprising a follower block, said follower block being supported on a pressure ball to press on a rear side of said front retaining block in such a manner that when said trigger is pressed to move said main bar backward, said front retaining block is forced to push follower block backward; said follower block is forced to impart a pressure to said pressure ball during a backward displacement of said main bar to perform a continuous multi-shot firing action.

13. The firearm firing system as claimed in claim 12, wherein said follower block comprises a bevel portion located at the rear side thereof and kept in contact with said pressure ball and adapted to impart a pressure to said pressure ball upon a backward movement of said front retaining block to push said follower block.

* * * * *